United States Patent [19]

Healey

[11] Patent Number: 4,741,384

[45] Date of Patent: May 3, 1988

[54] APPARATUS FOR MELTING, CASTING AND DISCHARGING A CHARGE OF METAL

[75] Inventor: George J. Healey, Nepean

[73] Assignee: GTE Products Corporation, Stamford, Conn.

[21] Appl. No.: 337,888

[22] Filed: Jan. 7, 1982

[51] Int. Cl.[4] ..... B22D 27/15

[52] U.S. Cl. ..... 164/514; 164/258; 164/269

[58] Field of Search ..... 164/61, 65, 253, 256, 164/258, 495, 514, 57.1, 269; 373/55, 90, 96

[56] References Cited

U.S. PATENT DOCUMENTS

| | | | |
|---|---|---|---|
| 1,205,309 | 11/1916 | Wright | 164/269 X |
| 2,686,822 | 8/1954 | Evans et al. | 164/514 X |
| 3,185,565 | 5/1965 | Taylor | 164/256 X |
| 3,201,835 | 8/1965 | Cooper et al. | 164/495 |
| 3,234,606 | 2/1966 | Smith | 164/258 X |
| 3,247,554 | 4/1966 | Hanks et al. | 164/258 X |
| 3,273,212 | 9/1966 | Garmy et al. | 164/514 X |
| 3,287,769 | 11/1966 | Hess et al. | 164/256 X |
| 3,342,250 | 9/1967 | Treppschuh et al. | 164/258 X |
| 3,369,067 | 2/1968 | De Corso | 373/90 |
| 4,095,643 | 6/1978 | Farlow et al. | 164/57.1 X |
| 4,240,497 | 12/1980 | Glazunov et al. | 164/253 X |

FOREIGN PATENT DOCUMENTS

| | | | |
|---|---|---|---|
| 540257 | 4/1957 | Canada | 164/514 |

*Primary Examiner*—Kuang Y. Lin

*Attorney, Agent, or Firm*—Donald R. Castle

[57] ABSTRACT

Apparatus for melting, casting and discharging a metal in a chamber. The apparatus includes a hopper outside of the furnace for delivering metal to a crucible inside of the furnace. The crucible pivots to pour molten metal into a mold which also pivots to pour solidified metal into a bin. The crucible, mold and bin are in a unitary chamber. Also provided is an improved electrode, crucible and mold.

14 Claims, 4 Drawing Sheets

APPARATUS FOR MELTING, CASTING AND DISCHARGING A CHARGE OF METAL

BACKGROUND OF THE INVENTION

The invention is directed to a furnace for melting and casting a charge of material. Without limitation, such material may include a metal, alloy, or the like. In particular the invention relates to such a furnace which comprises a unitary or single chamber in which the charge is continuously melted and metal ingots and the like continuously produced from the same mold or molds and continuously collected in an appropriate discharge bin without opening the chamber during the continuous process. Such chamber may be subjected to vacuum or partial vacuum or an inert atmosphere, if desired.

Generally, in prior art furnaces a charge of metal is fed to a crucible which is subjected to induction heating for the purpose of reducing the charge to a molten state. Subsequently, the molten metal is poured into a mold for casting and allowed to solidify as the metal cools. When the process is complete, the solidified metal or ingot is removed from the mold, and the process may then be repeated. It is often desirable to melt and cast the metal under a vacuum, or in an inert atmosphere, and to this end the crucible, mold and ingot removal means may be positioned in appropriate chambers. In order to facilitate the processing of such ingots with minimum furnace shut down time, known prior art furnaces may comprise a plurality of chambers equipped with sealed closures therebetween. For example, in Moore, U.S. Pat. No. 2,625,719, a vacuum casting apparatus is described which includes a vacuum chamber in which metal to be melted is fed, another vacuum chamber in which such metal is melted, and a third vacuum chamber in which an ingot is cast from the molten metal. The Moore structure also includes a plurality of vacuum-tight closures or valves, there being a first closure through which metal is introduced into the feeding chamber, a second closure between the feeding and furnace or melting chambers, a third closure between the furnace and casting chambers and a fourth closure for permitting the removal of the ingot from the casting chamber. In the process associated with such a prior art furnace, the seal at the first closure must be broken and the vacuum vented each time a fresh supply of metal is inserted. Subsequently, the first closure is resealed and the feeding chamber is evacuated to obtain the desired vacuum. The metal is then advanced through the feeding, melting and casting chambers by opening and closing the second and third vacuum-tight closures. As each individual ingot is cast and cooled, the vacuum-tight connection which forms the fourth closure is broken and the mold is removed. Before the process may be repeated, the seal at the first closure must once again be broken, the vacuum in the feeding chamber vented and a fresh supply of metal inserted therein, and the feeding chamber once again resealed and evacuated to obtain the desired vacuum. At the other end of the process, an empty mold must be replaced in the casting chamber, and the casting chamber must be sealed and evacuated to obtain the desired vacuum.

Other known prior art furnaces useful in producing cast metals may comprise a plurality of vacuum augmented chambers equipped with vacuum tight or sealed closures between select of such chambers. For example, the vacuum furnace described in Franks et al, U.S. Pat. No. 2,854,228 comprises a first vacuum furnace or melting chamber and a second vacuum chamber which includes the mold per se. The first and second chambers are not sealed relative to each other. However, each chamber is provided with separate evacuation means. A third vacuum chamber is provided for loading and unloading a launder, and such chamber is isolated from the vacuum furnace by means of a vacuum closure. To load or unload the launder, the vacuum seal or closure to the third chamber must be broken and the vacuum therein vented. The third chamber is provided with a separate evacuation means to evacuate the third chamber upon resealing thereof. Franks et al. appears to depict a structure similar to that described in Moore wherein as each individual ingot is cast and cooled, a vacuum-tight connection is broken to remove the mold thereby necessitating resealing and repeated evacuation each time the process is repeated.

A similar prior art furnace is described in Bussard et al., U.S. Pat. No. 3,014,255 wherein a first melting chamber is provided having a second chamber positioned underneath for casting, the chambers being evacuated by the same pump to create the necessary vacuum. An antechamber is provided with an inner airtight gate or closure leading to the casting chamber and an outer airtight gate leading to the outside. An exit chamber is provided and is also provided with an inner airtight gate or closure leading to the casting chamber and an outer airtight gate leading to the outside. The antechamber and exit chamber are also provided with evacuation means to provide vacuum chambers as required. In operation, molten metal is poured from the melting chamber into molds positioned upon carriage means in the casting chamber. The inner airtight gates or closures are opened to remove to the exit chamber the carriage and filled molds and to reposition into the casting chamber another carriage carrying unfilled molds. Such inner gates are then closed and the outer gates are opened to remove from the exit chamber the carriage and filled molds and to position into the antechamber a carriage with unfilled molds. The outer gates are then closed, and the antechamber and exit chamber are again subjected to evacuation to create the necessary vacuum. This process is repeated each time the molds positioned in the casting chamber are filled.

Other known prior art describes vacuum augmented furnaces comprising a plurality of vacuum chambers separated by sealed closures. In such furnaces, the vacuum is vented in at least one of the chambers each time the respective mold is emptied and such chamber requires additional vacuum augmentation prior to each time the mold is refilled and emptied again. Such structures are described in Tingquist et al., U.S. Pat. No. 3,336,971, Taylor et al., U.S. Pat. No. 3,554,268 and Bly et al., U.S. Pat. No. 3,635,791.

Problems resulting from the use of various prior art furnaces include the need to provide sealed gates or closures between isolated chambers and means to open and close such closures. In addition, in vacuum furnaces evacuation means must be provided for each isolated chamber. Such means will include separate vacuum lines and may require the use of separate vacuum sources or pumps. In operation, each time the mold or molds are emptied the vacuum is vented in at least one of the chambers, and such chamber will require additional vacuum augmentation prior to each time the mold or molds are refilled for further casting.

Another problem incurred in prior art furnaces is that the electrode crucible and mold tend to deteriorate as a result of the various stresses to which such equipment is exposed during use thereof. Such deterioration may be caused by, for example, continuous thermal expansion and contraction as temperatures continuously change throughout the melting and casting process, as well as thermal degradation.

Accordingly, it is an object of this invention to provide a furnace for melting, casting and discharging a charge of metal a unitary chamber.

Another object of this invention is to provide a furnace for melting, casting and discharging a charge of metal wherein the furnace does not require sealed gates or closures between isolated chambers, or means to open and close such closures. Still another object of this invention is to provide a furnace for melting, casting and discharging a charge of metal wherein the charge of metal does not require being fed through melting, casting and discharging chambers, one or more of which are sealed relative to others.

A further object of this invention is to provide a furnace for melting, casting and discharging a charge of metal under a vacuum wherein the furnace does not require the use of separate evacuation means for separate isolated vacuum chambers.

Still a further object of this invention is to provide a furnace for melting, casting and discharging a charge of metal under a vacuum in a unitary vacuum chamber wherein a crucible and mold may be emptied and refilled without venting the vacuum.

Yet another object of this invention is to provide a furnace for melting, casting and discharging a charge of metal under a vacuum in a unitary vacuum chamber wherein a crucible and mold may be emptied without subjecting the vacuum chamber to additional vacuum augmentation prior to each time the crucible and mold are refilled for further casting.

Another object of this invention is to provide an electrode which will resist the stresses to which it is subjected in a furnace used to melt, cast and discharge a charge of metal.

A further object of this invention is to provide a crucible which will resist the stresses to which it is subjected in a furnace used to melt, cast and discharge a charge of metal.

Yet another object of this invention is to produce a mold which will resist the stresses to which it is subjected in a furnace used to melt, cast and discharge a charge of metal.

SUMMARY OF THE INVENTION

This invention achieves these and other object by providing furnace having a chamber for melting, casting and discharging a charge of metal. Delivering means external of the chamber are provided for delivering a charge of metal to be fed into the chamber. Such delivering means may include a loading hopper, metering hopper and vibrating member. Discharging means is positioned internal of the chamber for receiving the charge of metal from the delivering means and discharging the charge into a melting means which is also internal of the chamber. For example, an elongated chute may receive a charge of metal from the delivering means and feed the charge into a crucible. The crucible heats the metal to a molten state and empties it into a molding means such as a mold. The molding means, which is internal of the chamber, solidifies the molten metal and empties it into a transporting means, such as a moveable bin, which is also positioned inside of the chamber.

Also provided is a mold and crucible each of which comprises a housing having a plurality of sides which surround a chamber. The housing is open at one side to expose the chamber. A refractory member is in the chamber adjacent the sides thereof. The mold and crucible also include means contiguous with the sides for cooling the housing and refractory member.

An electrode is also provided having a first open ended tubular member, an electrode head attached to one end thereof and an electrode tip attached to the other end thereof. The head and tip each have an internal cavity communicating with the hollow portion of the first tubular member. The head also includes at least a first and second conduit extending from the exterior of the head to the head cavity. A second tubular member extends internally through the first tubular member. One end of the second tubular member is attached to the first conduit and the opposite end extends into the tip cavity. Means are attached to the first conduit for conveying cooling fluid relative to the second tubular member. Means are attached to the second conduit for passing current to the electrode and conveying such cooling fluid relative to the first tubular member.

BRIEF DESCRIPTION OF THE DRAWINGS

This invention may be clearly understood by reference to the attached drawings in which.

DESCRIPTION OF THE PREFERRED EMBODIMENT

Figures 1, 7, 8:
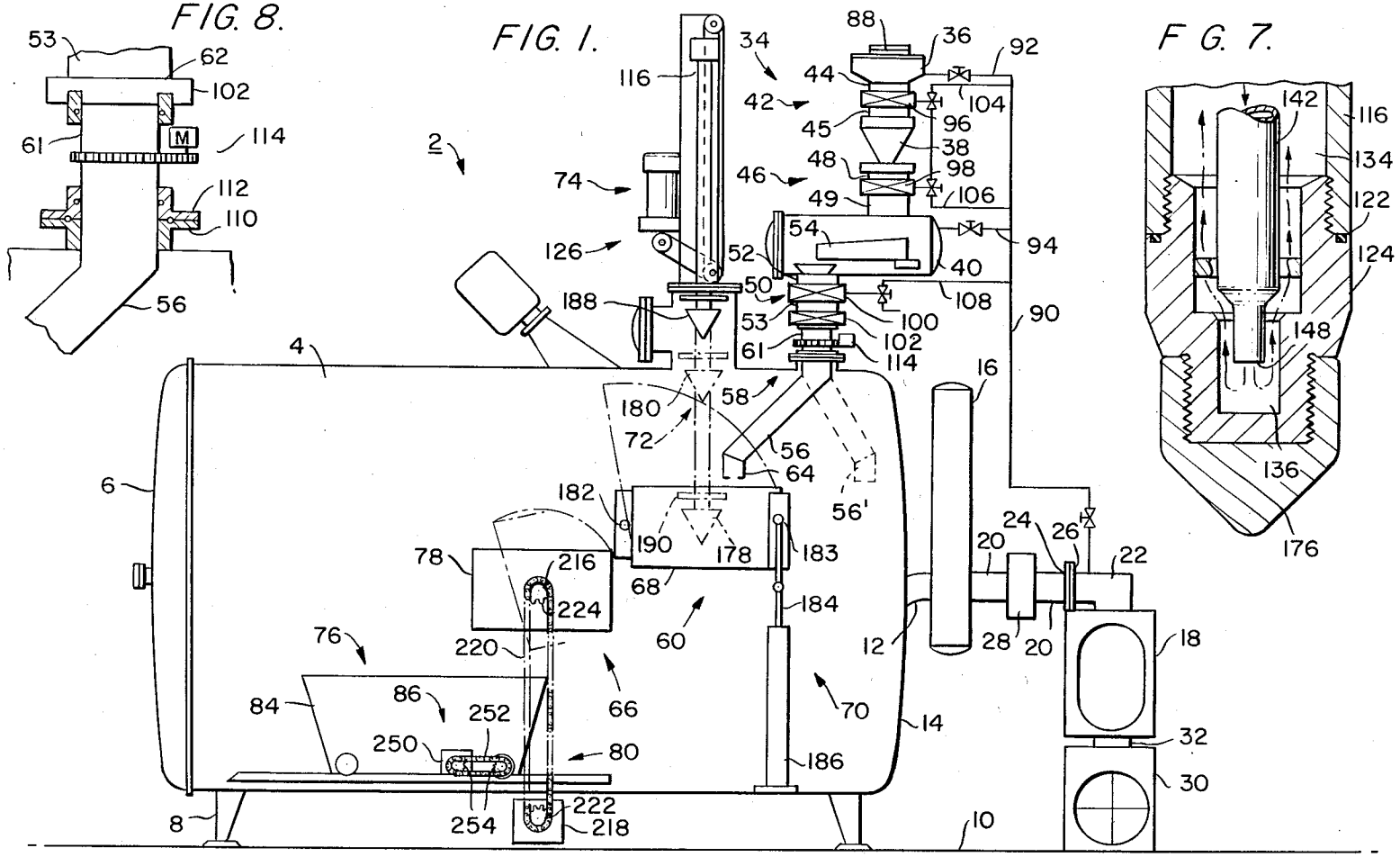
FIG. 1 is a diagrammatic representation of one embodiment of the furnace of the present invention.
FIG. 7 is a sectional view of FIG. 4 taken along line 7—7.
FIG. 8 is a detailed view of the chute pivoting mechanism of FIG. 1.

The embodiment of this invention which is depicted in the drawings is one which is particularly suited for achieving the objects of the invention. FIG. 1 depicts a furnace 2 for melting, casting and discharging a charge of metal under a vacuum. The furnace comprises a vacuum-tight chamber 4 including a sealed door or closure 6 at one end thereof. Chamber 4 is supported by means of legs 8 which space the chamber from the surface 10. A conduit 12 communicates with the inside of chamber 4 through end 14. Conduit 12 also communicates with the inlet side of filter 16 The outlet side of filter 16 communicates with a blower 18 by means of conduits 20 and 22 which are connected at flanges 24 and 26. A vacuum valve 28 is positioned in conduit 20 between filter 16 and blower 18. Blower 18 is connected to a pump 30 by means of conduit 32. A vacuum may be created within chamber 4 by means of pump 30 and blower 18.

Furnace apparatus 2 also includes a delivering means generally designated 34. Delivering means 34 is external of chamber 4 and attached thereto by means of an elongated chute, as described herein, for delivering a charge of metal to be fed into chamber 4. For example, delivering means 34 may include a loading hopper 36, a metering hopper 38 and a vacuum housing 40. Loading hopper 36 is in communication with and connected to metering hopper 38 by a first connecting means 42. First connecting means 42 includes first conduits 44, 45 which extend between loading hopper 36 and metering hopper 38. Similarly, metering hopper 38 is in communication with and connected to vacuum housing 40 by a second connecting means 46 which includes second conduits 48, 49 extending between metering hopper 38 and vacuum housing 40. Vacuum housing 40 is in communication with vacuum chamber 4 by a third connecting means 50 which includes third conduits 52, 53 extending between vacuum housing 40 and a valve as described herein.

Vacuum housing 40 includes a vibrating means 54 therein for receiving a metal charge from metering hopper 38, as described below, through second conduits 48, 49 of the second connecting means 46. Vibrating means 54 may be any known device useful in agitating the metal charge and feeding it through third conduits 52, 53 of third connecting means 50.

A discharging means generally designated 58 is provided internal of the vacuum chamber 4. Discharging means 58 is attached for movement relative to a melting means generally designated 60 for receiving the charge of metal from the delivering means 34 and discharging the charge into the melting means 60. More particularly, discharging means 58 includes an elongated chute 56, one end 61 of which communicates with one end 62 of the third conduit 53 of third connecting means 50 of the delivering means 34. The other end 64 of chute 56 extends into chamber 4.

Melting means 60 is also internal of chamber 4. Melting means 60 is attached for movement relative to molding means, generally designated 66, for receiving the charge of metal from the discharging means 58, heating the metal to a molten state and emptying the molten metal into molding means 66. More particularly, melting means 60 includes a crucible 68. Pivoting means, generally designated 70, is attached to crucible 68 for pivoting the crucible into pouring relationship relative to molding means 66 and receiving relationship relative to discharging means 58.

Melting means 60 further includes an electrode generally designated 72. Moving means, generally designated 74, is attached to electrode 72 for moving the electrode into and out of heating relationship relative to crucible 68.

Molding means 66 is also internal of chamber 4. Molding means 66 is attached for movement relative to a transporting means 76, for receiving said molten metal from melting means 60, solidifying the metal and emptying the metal into the transporting means. More particularly, molding means 66 includes a mold 78. Pivoting means, generally designated 80, are attached to the mold 78 for pivoting the mold into pouring relationship relative to crucible 68.

Transporting means 76 is also internal of chamber 4. Transporting means 76 is moveable relative to molding means 66 for receiving the solidified metal from and transporting the solidified metal relative to the molding means 66. More particularly, transporting means 82 includes a storage bin 84. Moving means, generally designated 86, are attached to bin 84 for moving the bin into receiving relationship relative to mold 78 and away from the mold for emptying the bin.

In operation, loading hopper 36 is filled with a charge of metal sufficient to last, for example, for a day of operation of the furnace apparatus 2. For example, hopper 36 may be filled with about 1000 kilograms of mixture of tungsten and carbon, or tungsten carbide and tungsten. In loading hopper 36, lid 88 is removed and the metal charge is deposited in the hopper. It is desired to seal hopper 36 and to this end lid 88 is provide with a sealing means such as an O-ring (not shown). After the lid is replaced, hopper 36 is placed under a vacuum by blower 18 which is connected to the hopper through conduits 90 and 92. Vacuum housing 40 is also placed under a vacuum by blower 18 through conduit 94.

In the preferred embodiment first connecting means 42 includes at least one valve 96 attached to conduits 44, 45. Similarly second connecting means 46 includes at least one valve 98 attached to conduits 48, 49. Third connecting means 50 includes at least one valve 100 attached to conduits 52, 53. Conduit 53 may have an additional valve 102 attached thereto.

In order to properly charge the crucible 68 with the desired amount of metal, valve 96 is opened and an amount of metal is deposited from loading hopper 36 to metering hopper 38 through conduits 44, 45. Then valve 96 is closed and valve 98 is opened. Metering hopper 38 delivers a predetermined amount of metal to the vibrating means 54 in vacuum housing 40 through conduits 48, 49 and then valve 98 is closed. In the preferred embodiment such predetermined amount of metal is about 35 kilograms. Subsequently, valves 100 and 102 are opened and vibratory means 54 agitates and feeds the metal charge through conduits 52 and 53 and into vacuum chamber 4 through elongated chute 56. As depicted in the drawings end 61 of chute 56 is attached to valve 102. The feeding of the charge may be at a controlled rate and to this end vibrating means 54 may be a vibratory trough or shaker of the type wherein the rate of feeding is controlled by varying as desired the rate of vibration. Such a device is known in the art and is therefore not described herein.

Valves 96, 98, 100 and 102 may be any type suitable for the intended purpose. In the preferred embodiment valves 96, 98 and 100 are of the type referred to in the trade as "rubber vacuum valves" which generally comprise a metal shell having a rubber sleeve therein which is caused to collapse into a closed position when a fluid under pressure such as argon gas is inserted between the shell and the sleeve. The valves may be caused to resume a normal opened position by withdrawing the pressurized fluid and to this end valves 96, 98 and 100 are connected to blower 18 through conduit 90 by conduits 104, 106 and 108, respectively. Rubber vacuum valves are known in the art and further details are not depicted in the drawings. Vacuum valves may not provide a perfect seal and therefore a mechanical valve 102 is also provided.

The charge of metal being delivered to vacuum chamber 4 through elongated chute 56 is caused to be deposited into crucible 68 by positioning the chute 56 as depicted in the drawing such that end 64 is immediately above the crucible. After the metal charge has been deposited in crucible 68, the chute 56 is caused to pivot and is preferably thereby moved near the inner wall of vacuum chamber 4 which position is generally designated 56'. This movement is such that the chute 56 will not interfer with movement of crucible 68. In addition, chute 56 will not be exposed to the heat generated by electrode 72 during the heating of the metal charge in crucible 68. The elongated chute 56 has one end moveably attached to furnace 2 by nylon bearings and a suitable packing gland comprising O-rings, as generally depicted at the interface of flanges 110, 112. A similar connection is made at valve 102. Chute 56 is caused to pivot by any means known in the art which in the preferred embodiment includes a standard sprocket and gear arrangement driven by a motor. This mechanism is generally designated 114 in the drawings.

After crucible 68 has been charged with metal and chute 56 has been pivoted away towards the inner wall of furnace 2 electrode 70 is caused to be moved into heating relationship relative to crucible 8. More particularly, and referring to FIGS. 1, 4, 5, 6 and 7, in the preferred embodiment electrode 72 comprises a first open ended tubular member 116 to one end 118 of which is attached an electrode head 120 and to the other end 122 of which is attached an electrode tip 124 and cap 176. The electrode 72 is caused to move into heating relationship relative to crucible 68 by being lowered such that tip cap 176 enters crucible 68 and engages the metal charge therein. Moving means 74 may be any means known in the art suitable for causing electrode 72 to move as described herein In the preferred embodiment, moving means 74 includes a sprocket and chain arrangement driven by a motor. This mechanism is generally Designated 126. It will be apparent from the drawings that by energized the motor the chain is caused to move electrode 72 upward downward, as desired. Electrode 72 is moveably attached to chamber 4 by suitable means which will allow for such vertical movement. For example, in the preferred embodiment the electrode extends through a nylon bearing at the interface of flanges 128, 130. To assure that the vacuum chamber remains sealed at such connection, a packing gland comprising a plurality of O-rings may be used.

In order to heat the charge of metal in crucible 68, electrode 72 includes a copper electrode head 120 having an internal cavity 132 communicating with the hollow portion 134 of the first tubular member 116 which is also copper. A copper electrode tip 124 includes an internal cavity 136 which also communicates with the hollow portion 134 of first tubular member 116. Since head 120, tubular member 116 and tip 124 are connected to one another and are copper, electrode 72 is conductive and current can be caused to flow from head 120 to tip 122. Electrode head 120 further includes at least a first conduit 138 and a second conduit 140 extending from the exterior of head 120 to the head cavity 132. A second tubular member 142 is positioned internal of and extends through the first tubular member 116. One end 144 of the second tubular member 142 is attached to the first conduit 138 at one end 146. The other end 148 of the second tubular member 142 extends into the tip cavity 136. Means 150 is attached to the other end 152 of the first conduit 138 for conveying cooling fluid relative to the second tubular member 142. Means 154 is attached to one end 156 of second conduit 140 for passing current to the electrode 72 and conveying cooling fluid relative to the first tubular member 116. In the preferred embodiment there is a plurality of second conduits 140. As in the preferred embodiment means 150 comprises a hose 158 for injecting water into second tubular member 142. Similarly, means 154 comprises a plurality of hoses 160 for receiving water from first tubular member 116 Each of hoses 160 is of a type known in the art wherein the end portion of the hose includes appropriate wiring which allows current to be passed to electrode 72 when such a hose 160 is attached to the electrode head 120 at end 156. In other words, an electrical connection is formed at end 156 when a hose 160 is connected thereto. Of course, the other end of the wiring is attached to an appropriate electrical source of power. Each of hoses 160 also comprises an internal tubular cavity running throughout the length of the hose for allowing water received from first tubular member 116 to flow through the hose.

In operation, the mechanism 126 is actuated such that the motor 162 drives the sprockets 164, 166, 168 and chains 170, 172 to lower electrode 72 including its tip 124 into crucible 68 such that the graphite tip cap 176 engages the metal charge in the crucible. To this end chain 172 is attached to electrode 72 at 174. Current is supplied from a power source, not shown, through the wiring at the end of hoses 160. The current passes through the copper electrode head 120, copper first tubular member 116 and copper electrode tip 124 which has attached thereto the graphite tip cap 176. The arc passes through the metal charge and crucible, and the current leaves the chamber through the crucible and the attached hollow axle 182 upon which the crucible pivots as described herein. Such axle is part of framework (not shown) attached to the furnace inner wall. The current is of sufficient amperage to strike an arc to raise the temperature of the charge rapidly from about 300° to about 3000° C. By way of example, the electrode useful therefore where it is desired to produce cast carbides from, for example, a mixture of tungsten powder and carbon or tungsten carbide and tungsten. Such a mixture will melt at about 2900° C. During the heating and melting operation of the electrode, the electrode is continuously cooled by causing water to enter the second tubular member 142 from hose 158 through first conduit 138. The water passes downwardly through second tubular member 142 and enters cavity 136 of electrode tip 124. The water progresses upwardly in the hollow portion 134 between first tubular member 116 and second tubular member 142 and exits from electrode 72 through cavity 132, conduits 140 and hoses 160.

Upon completion of the melting of the charge of metal in crucible 68, motor 162 drives sprockets 164, 166, 168 and chains 170, 172 in such a manner as to rapidly raise electrode 72, including its tip 124 from a first or melting position indicated in phantom lines at 178, out of and away from crucible 68 to a second position indicated in phantom lines at 180. In the preferred embodiment electrode 72 trips a microswitch (not shown) when the electrode 72 is at position 180 thereby causing movement of the electrode to cease and also causing crucible 68 to be pivoted about axle 182 to the position shown in FIG. 1 in phantom lines to empty the molten metal into mold 78. Crucible 68 is attached to axle 182 so that the crucible will pivot about the axle. The axle is also attached to framework (not shown) which is attached to the furnace wall. Pivoting movement is caused by pivoting means 70 which includes linkage 184 attached to a hydraulic cylinder 186 and to the crucible at 183. In view of the intense heat generated by electrode 72, the electrode may be allowed to cool down, as desired, at position 180. Subsequently, motor 162 is again energized and electrode 72 is moved to a third position indicated in solid lines at 188 at which position a second microswitch (not shown) causes movement of the electrode to cease. In the preferred embodiment a heat shield 190 may be attached to tubular member 116. Such shield is spaced from electrode head 124, as desired, and may comprise a refractory material such as, for example, graphite.

Figure 2:
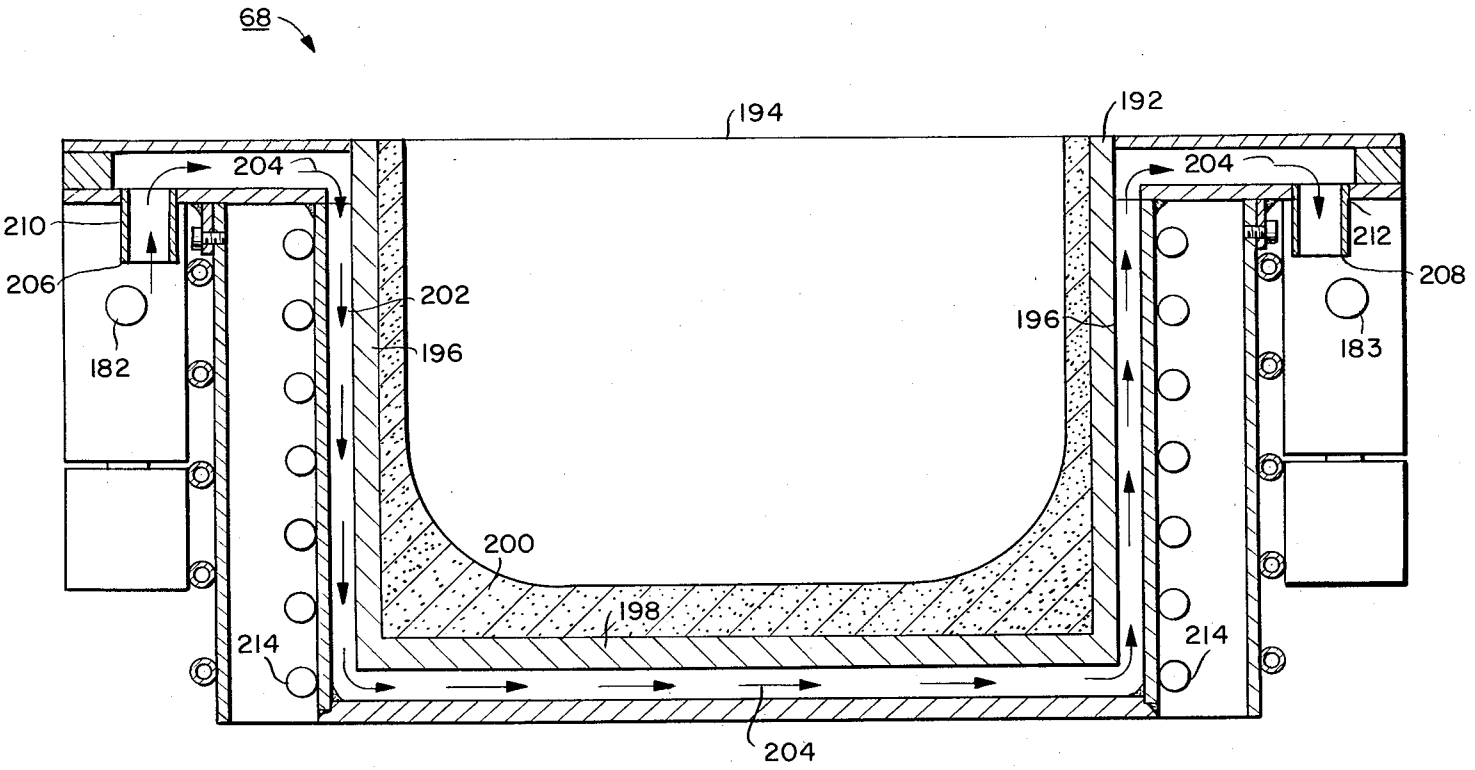
FIG. 2 is an elevational view partially broken away of one embodiment of the crucible of the present invention.

Referring to FIG. 2, crucible 68 may be a container including a copper housing 192 which is open ended to form a chamber 194 surrounded by a plurality of sides 196, including the bottom 198. The chamber includes a refractory member adjacent sides 196, 198 which in the preferred embodiment includes an open ended container 200 positioned within the open ended housing 192. Container 200 comprises a refractory material such as, for example, graphite. Crucible 68 also includes means contiguous with the sides for cool ing the housing and refractory member. Such cooling means includes at least one conduit 202 which extends about the periphery of the housing 192 such that a cooling fluid such as water may pass through the conduit as indicated by arrows 204. Conduit 202 includes at least one inlet end 206 and one outlet end 208 each of which extend to a position external of the housing at position 210 and 212, respectively. Ends 206 and 208 may be connected to means for supplying and draining, respectively, water from conduit 202. Although not shown, ends 206 and 208 may be connected to a hollow axle of crucible 68, which axle may extend through the furnace wall. In the preferred embodiment, conduit 202 is machined in said side members. An induction coil 214 extends about the periphery of sides 196. By controlling the direction of current running through the coil, the molten metal in crucible 68 is stirred in a clockwise or counterclockwise direction to assure uniform melting by uniformly distributing the heat throughout the metal.

After the molten metal has been poured from crucible 68 to mold 78 hydraulic cylinder 186 is again actuated to cause the crucible to pivot to the position shown in FIG. 1 in solid lines. The molten metal is cooled and solidified in mold 78, and the mold is then pivoted about axle 216 to the position shown in FIG. 1 in phantom lines to empty the solidified metal into the bin 84. Pivoting movement is caused by pivoting means 80 which includes motor 218 which drives chain 220 through gears 222, 224. When the mold 78 has been emptied the motor 218 is again actuated to cause the mold to pivot to the position shown in FIG. 1 in solid lines.

Figure 3:
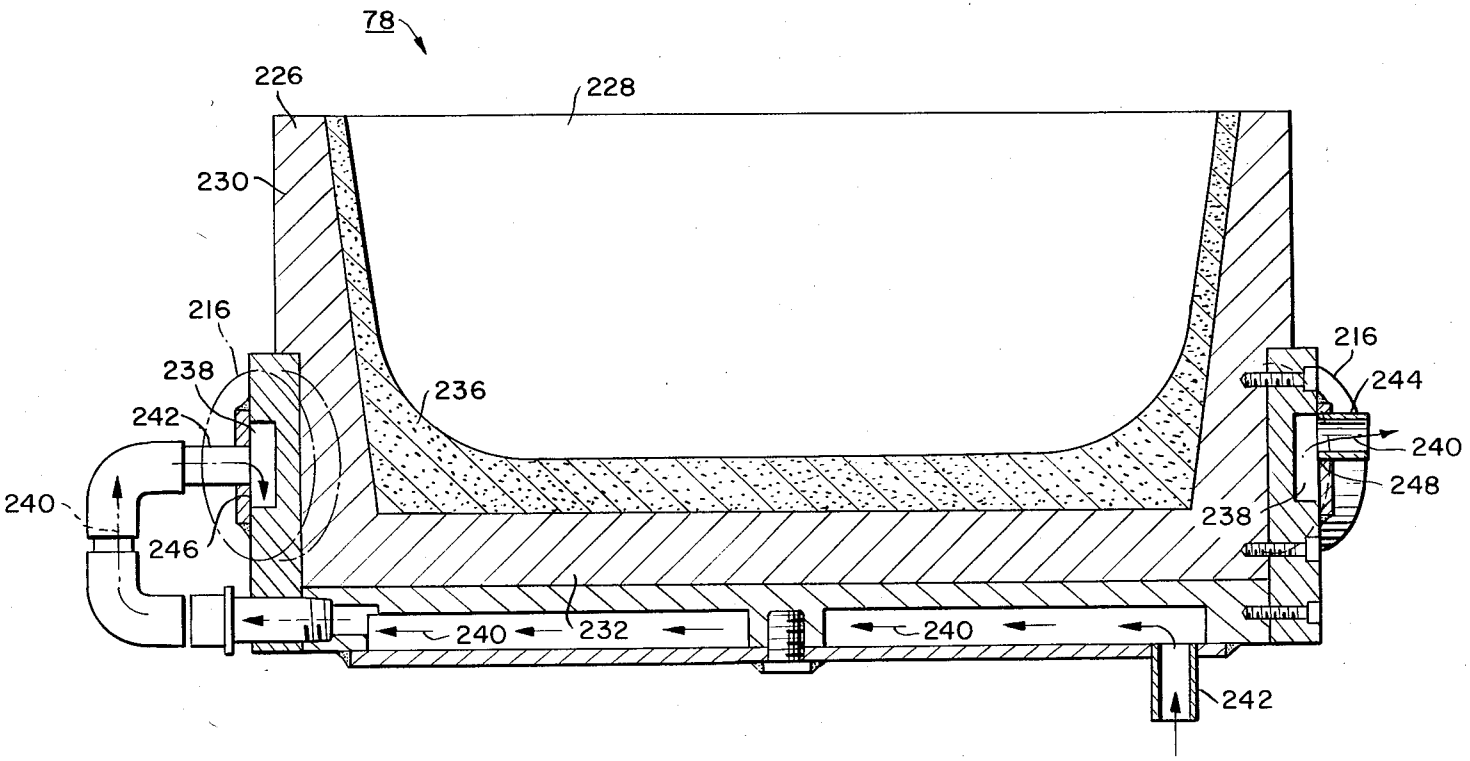
FIG. 3 is an elevational view partially broken away of one embodiment of the mold of the present invention.
Figure 4:
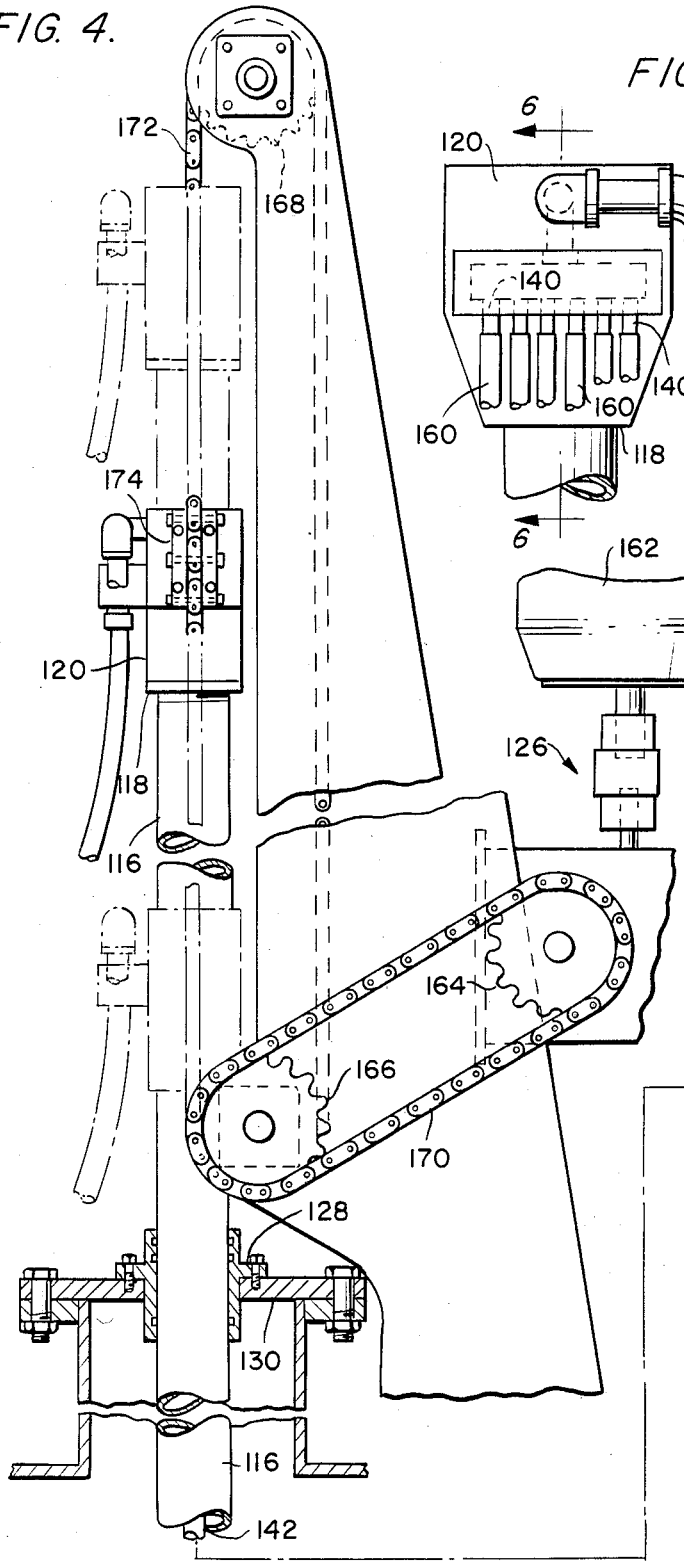
FIG. 4 is an elevational view partially broken away of one embodiment of the electrode of the present invention.
Figure 5:
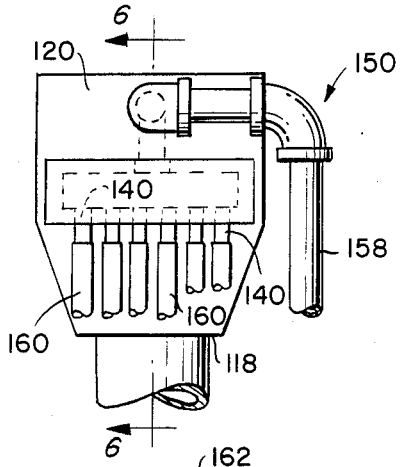
FIG. 5 is a view of the electrode head of FIG. 4.
Figure 5:
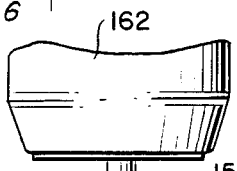
Figure 6:
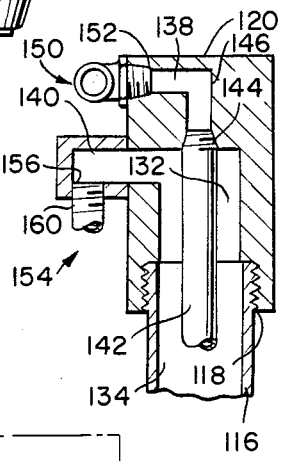
FIG. 6 is a sectional view of FIG. 5 taken along lines 6—6.
Figure 6:
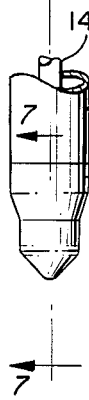

As depicted in FIG. 3, the mold 78 is similar to crucible 68 in several respects. Mold 78 may be a container including a copper housing 226 which is open ended to form a chamber 228 surrounded by a plurality of sides 230, including the bottom 232. The chamber includes a refractory member adjacent sides 230, 232 which in the preferred embodiment includes an open ended container 236 positioned within the open ended housing 226. Container 236 comprises a refractory material such as, for example, graphite. Mold 78 also includes means contiguous with the sides for cooling the housing and refractory member. Such cooling means includes at least one conduit 238 which extends about the periphery of the housing 226 such that a cooling fluid such as water may pass through the conduit as indicated by arrows 240. Conduit 238 includes at least one inlet end 242 and one outlet end 244 each of which extend to a position external of the housing at position 246 and 248, respectively. Ends 242 and 244 may be connected to means for supplying and draining, respectively, water from conduit 238. Although not shown, ends 242 and 244 may be connected to a hollow axle such as axle 216 which may extend through the furnace wall.

The operation described above may be continuously repeated for as long as desired until bin 84 is full. When it is desired to empty the bin, the vacuum within chamber 4 is relieved, door 6 is opened and moving means 86 is actuated. In particular, motor 250 causes the bin to move through chain 252 and sprockets 254. Subsequently an additional charge of metal may be processed by returning the bin to a position as depicted in the drawing for receiving solidified metal from mold 78, closing door 6 and subjecting chamber 4 to a vacuum. Additional metal charge is added to hopper 36 if required of desired.

Although a vacuum furnace has been described the present invention includes any other type of furnace including, without limitation, a furnace subjected to a partial vacuum and a furnace subjected to an inert atmosphere.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. Apparatus for melting, casting and discharging a metal comprising a chamber;

delivering means external of said chamber and attached for delivering a charge of metal to be fed into said chamber;

discharging means internal of said chamber and attached for pivotal movement relative to a melting means for receiving said charge of metal from said delivering means and discharging said charge into said melting means;

melting means internal of said chamber and attached for movement relative to a molding means for receiving said charge of metal from said discharging means, heating said metal to a molten state and emptying said molten metal into said molding means;

molding means internal of said chamber and attached for movement relative to a transporting means for receiving said molten metal from said melting means, solidifying said metal and emptying said solidified metal into transporting means; and transporting means internal of said chamber and moveable relative to said molding means for receiving said solidified metal from and transporting said solidified metal relative to said molding means.

2. The apparatus of claim 1 wherein said discharging means comprises an elongated chute, one end of which communicates with said delivering means and the other end of which extends into said chamber.

3. The apparatus of claim 2 wherein said melting means comprises a crucible and means attached to said crucible for pivoting said crucible into pouring relationship relative to said molding means and receiving relationship relative to said discharging means.

4. The apparatus of claim 3 wherein said melting means further comprises an electrode and means attached to said electrode for moving said electrode into and out of heating relationship relative to said crucible.

5. The apparatus of claim 4 wherein said molding means comprises a mold and means attached to said mold for pivoting said mold into pouring relationship relative to said transporting means and receiving relationship relative to said crucible.

6. The apparatus of claim 5 wherein said transporting means comprises a storage bin and means attached to said bin for moving said bin into receiving relationship relative to said mold and away from said mold for emptying said bin.

7. The apparatus of claim 6 wherein said delivering means comprises a loading hopper, a metering hopper and a housing, said loading hopper being in communication with and connected to said metering hopper by a first connecting means, said metering hopper being in communication with and connected to said housing by a second connecting means, and said housing being in communication with said chamber by a third connecting means, said third connecting means being in communication with said elongated chute, and wherein said housing comprises vibrating means therein for receiving said metal charge from said metering hopper through said second connecting means and agitating and feeding said metal charge through said third connecting means to said elongated chute.

8. The apparatus of claim 7 wherein said first connecting means comprises first conduits extending between said loading hopper and said metering hopper, at least one valve being attached to said first conduits, said second connecting means comprises second conduits extending between said metering hopper and said housing, at least one valve being attached to said second conduits, and said third connecting means comprises third conduits extending between said housing and being in communication with said chamber through said elongated chute, at least one valve being attached to said third conduits.

9. The apparatus of claim 8 wherein said crucible and said mold each comprise (a) a housing having a plurality of sides which defines a member capable of receiving, retaining and discharging material, said housing being open at one side to expose said member capable of receiving, retaining and discharging material;

(b) a refractory member in each of said member capable of receiving, retaining and discharging material adjacent said sides; and, (c) means contiguous with said sides for cooling said housing and said refractory member.

10. The apparatus of claim 9 wherein said cooling means comprises at least one conduit extending about the periphery of said housing and having at least one inlet end and at least one outlet end, said ends extending to a position external of said housing.

11. The apparatus of claim 10 wherein said conduit is positioned within said sides.

12. The apparatus of claim 11 wherein said refractory member comprises an open ended container positioned within said open ended housing, said member comprising a refractory material.

13. The apparatus of claim 4 wherein said electrode comprises a first open ended tubular member, an electrode head attached to one end of said first tubular member, said head having an internal cavity communicating with the hollow portion of said first tubular member, an electrode tip attached to the other end of said first tubular member, said tip having an internal cavity communicating with the hollow portion of said first tubular member, said head having at least a first and second conduit extending from the exterior of said head to said head cavity, a second tubular member internal of and extending through said first tubular member, one end of said second tubular member attached to one end of said first conduit and the other end of said second tubular member extending into said tip cavity, means attached to each of said second conduits for passing current to said electrode and conveying cooling fluid relative to said first tubular member and means attached to another end of said first conduit for conveying cooling fluid relative to said second tubular member.

14. The apparatus of claim 13 wherein there are a plurality of said second conduits.

* * * * *